US011435127B2

(12) United States Patent
Song et al.

(10) Patent No.: US 11,435,127 B2
(45) Date of Patent: Sep. 6, 2022

(54) REFRIGERATOR

(71) Applicant: Samsung Electronics Co., Ltd., Suwon-si (KR)

(72) Inventors: Joohee Song, Suwon-si (KR); Hyejeong Oh, Suwon-si (KR); Sungi Hong, Suwon-si (KR); Kihyun Kim, Suwon-si (KR); Yonghan Kim, Suwon-si (KR); Juyoung Yoon, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 223 days.

(21) Appl. No.: 17/001,862

(22) Filed: Aug. 25, 2020

(65) Prior Publication Data

US 2021/0063073 A1 Mar. 4, 2021

(30) Foreign Application Priority Data

Aug. 30, 2019 (KR) ..... 10-2019-0107289

(51) Int. Cl.
*F25D 11/02* (2006.01)
*F25D 17/04* (2006.01)
(Continued)

(52) U.S. Cl.
CPC ..... *F25D 17/045* (2013.01); *F25D 11/02* (2013.01); *F25D 23/069* (2013.01);
(Continued)

(58) Field of Classification Search
CPC ..... F25D 11/02; F25D 25/025; F25D 29/003; F25D 17/045; F25D 17/062; F25D 23/069
See application file for complete search history.

(56) References Cited

U.S. PATENT DOCUMENTS 7,490,915 B2 * 2/2009 O'Halloran ..... F25D 25/025 312/348.3
8,733,867 B2 * 5/2014 Hwang ..... F25D 23/069 312/402
(Continued)

FOREIGN PATENT DOCUMENTS

JP 5802506 B2 10/2015
KR 10-2004-0082702 A 9/2004
(Continued)

OTHER PUBLICATIONS

International Search Report dated Nov. 13, 2020 in connection with International Patent Application No. PCT/KR2020/009924, 3 pages.

*Primary Examiner* — Filip Zec

(57) ABSTRACT

A refrigerator including a main body, a storage compartment provided in the main body and having an open front side, a storage box configured to be drawn out or put into the storage compartment and having a storage space therein, a cold air duct provided at the rear of the storage compartment and including a cold air outlet to allow cold air to be discharged into the storage space, a partition disposed in the storage box to divide the storage space into a fresh room and a vegetable room and to be movable in the left and right directions in the storage space, and a cold air adjusting member configured to be moved in the left and right directions together with the partition to adjust a size of the cold air outlet and to stay connected to the partition when the storage box is drawn out.

20 Claims, 16 Drawing Sheets

(51) Int. Cl.
*F25D 23/06* (2006.01)
*F25D 29/00* (2006.01)
*F25D 25/02* (2006.01)

(52) U.S. Cl.
CPC ..... *F25D 25/025* (2013.01); *F25D 29/003* (2013.01); *F25D 2317/00* (2013.01); *F25D 2500/06* (2013.01)

(56) References Cited

U.S. PATENT DOCUMENTS

| | | | | |
|---|---|---|---|---|
| 8,960,824 | B2 | 2/2015 | Wilcox et al. | |
| 2006/0250062 | A1* | 11/2006 | Janda | A47B 88/90 312/348.3 |
| 2009/0230832 | A1* | 9/2009 | Shin | F25D 25/025 312/404 |
| 2010/0319391 | A1* | 12/2010 | Lim | A47B 88/975 62/449 |
| 2015/0253064 | A1 | 9/2015 | Kim et al. | |

FOREIGN PATENT DOCUMENTS

| | | | |
|---|---|---|---|
| KR | 10-0570531 | B1 | 4/2006 |
| KR | 10-2013-0103944 | A | 9/2013 |
| KR | 10-2015-0062662 | A | 6/2015 |
| KR | 10-2019-0092021 | A | 8/2019 |

* cited by examiner

REFRIGERATOR

CROSS-REFERENCE TO RELATED APPLICATION

This application is based on and claims priority under 35 U.S.C. § 119 to Korean Patent Application No. 10-2019-0107289, filed on Aug. 30, 2019, in the Korean Intellectual Property Office, the disclosure of which is incorporated by reference herein in its entirety.

BACKGROUND

1. Field

The disclosure relates to a refrigerator in which an amount of cold air discharged into a storage space of a storage box divided into a fresh room and a vegetable room by a partition is automatically adjusted according to the movement of the partition.

2. Description of the Related Art

Generally, a refrigerator is an appliance which includes a main body provided with a storage compartment therein, a cold air supply system supplying; cold air to the storage chamber, and a door opening and closing the storage chamber, thereby storing food in a fresh state.

A storage box is provided to be drawn out from or put into the storage compartment. A storage space is provided inside the storage box to store food and the like. The storage space is divided into a fresh room and a vegetable room by a partition. By cold air discharged from a cold air outlet, the fresh room is maintained at a temperature of about 0 degrees, and the vegetable room is maintained at a temperature of about 3 degrees.

Sizes of the fresh room and vegetable room need to be adjusted to be suitable for an amount of food stored in the fresh room and vegetable room. In addition, as the sizes of the fresh room and the vegetable room are adjusted, an amount of cold air discharged to the fresh room and the vegetable room needs to be adjusted to maintain the fresh room and the vegetable room at a predetermined temperature.

SUMMARY

It is an aspect of the disclosure to provide a refrigerator capable of allowing a fresh room and a vegetable room to be maintained at different temperatures by automatically adjusting a size of a cold air outlet, through which cold air is discharged into a storage space of a storage box divided into the fresh room and the vegetable room by a partition provided to be movable in the left and right directions, according to the movement of the partition.

Additional aspects of the disclosure will be set forth in part in the description which follows and, in part, will be obvious from the description, or may be learned by practice of the disclosure.

In accordance with an aspect of the disclosure, a refrigerator includes a main body, a storage compartment provided in the main body and having an open front side, a storage box configured to be drawn out or put into the storage compartment and having a storage space therein, a cold air duct provided at the rear of the storage compartment and including a cold air outlet to allow cold air to be discharged into the storage space, a partition disposed in the storage box to divide the storage space into a fresh room and a vegetable room and to be movable in the left and right directions in the storage space, and a cold air adjusting member configured to be moved in the left and right directions together with the partition to adjust a size of the cold air outlet, the cold air adjusting member being remaining connected to the partition when the storage box is drawn out.

The cold air adjusting member may include an adjusting plate configured to adjust the size of the cold air outlet, and a connection bar connected to the adjusting plate and provided to be slidably moved in the front and rear directions with respect to the partition.

The partition may include an insertion hole through which the connection bar is slidably movable in the front and rear directions.

The cold air duct may include a cold air duct cover to cover a front surface of the cold air duct, and the cold air duct cover may include a first cold air duct cover to cover an upper front of the cold air duct, and a second cold air duct cover coupled to a lower portion of the first cold air duct cover to cover a lower front of the cold air duct.

The second cold air duct cover may include a guide hole configured to guide the connection bar to be moved in the left and right directions and to allow cold air discharged to the cold air outlet to be introduced into the storage space.

The connection bar may include a guide portion guided by the guide hole.

The cold air outlet may be formed on one side of the cold air duct at a position corresponding to the fresh room such that cold air is discharged only to the fresh room in the storage space.

When the partition is moved in a direction in which a size of the fresh room becomes small together with the cold air adjusting member, cold air may be discharged from the entire cold air outlet to the fresh room while the partition is being moved to a first position, which is a position before the adjusting plate closes the cold air outlet.

When the partition is further moved from the first position in a direction in which the size of the fresh room becomes small so that the partition is moved to a second position where a portion of the cold air outlet is closed by the adjusting plate, an amount of cold air discharged from the cold air outlet to the fresh room may be decreased.

The cold air outlet may have a length extending in the left and right directions of the cold air duct such that cold air is discharged to both the fresh room and the vegetable room.

A portion of the cold air outlet closed by the adjusting plate may be adjusted. according to a position of the partition so that an amount of cold air discharged to the fresh room and the vegetable room is adjusted.

When the partition is moved in a direction in which a size of the vegetable room becomes small, the cold air outlet may be adjusted in size by the adjusting plate so that a portion for allowing cold air to be discharged to the vegetable room becomes small and a portion for allowing cold air to be discharged to the fresh room becomes large.

When the partition is moved in a direction in which a size of the fresh room becomes small, the cold air outlet may be adjusted in size by the adjusting plate so that a portion for allowing cold air to be discharged to the fresh room becomes small and a portion for allowing cold air to be discharged to the vegetable room becomes large.

The storage box may include an opening formed in a rear wall thereof to allow the cold air adjusting member to be movable in the left and right directions together with the partition.

The partition may include a first slide moving portion coupled to an upper portion of a front wall of the storage box to be slidably movable in the left and right directions, and a second slide moving portion coupled to a lower wall of the opening to be slidably movable.

In accordance with another aspect of the disclosure, a refrigerator includes a main body, a storage compartment provided in the main body and having an open front side, a storage box configured to be drawn out or put into the storage compartment and having a storage space therein, a cold air duct provided at the rear of the storage compartment and including a cold air outlet to allow cold air to be discharged into the storage space, and a partition disposed in the storage box to divide the storage space into a fresh room and a vegetable room and to be movable in the left and right directions in the storage space, the partition including an adjusting plate configured to be moved in the left and right directions to adjust a size of the cold air outlet.

The cold air outlet may be formed on one side of the cold air duct at a position corresponding to the fresh room such that cold air is discharged only to the fresh room in the storage space.

When the partition is moved in a direction in which a size of the fresh room becomes small, cold air may be discharged from the entire cold air outlet to the fresh room while the partition is being moved to a first position, which is a position before the adjusting plate closes the cold air outlet.

When the partition is further moved from the first position in a direction in which the size of the fresh room becomes small so that the partition is moved to a second position where a portion of the cold air outlet is closed by the adjusting plate, an amount of cold air discharged from the cold air outlet to the fresh room may be decreased.

The cold air outlet may have a length extending in the left and right directions of the cold air duct such that cold air is discharged to both the fresh room and the vegetable room, and a portion of the cold air outlet closed by the adjusting plate may be adjusted according to a position of the partition so that an amount of cold air discharged to the fresh room and the vegetable room is adjusted.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

FIGS. 1 through 16, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations shown in the embodiments and the drawings described in the present specification are only the preferred embodiments of the present disclosure, and thus it is to be understood that various modified examples, which may replace the embodiments and the drawings described in the present specification, are possible when filing the present application.

Like reference numbers or signs in the various figures of the application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that although the terms first, second, etc. may be used herein to describe various components, these components should not be limited by these terms, and the terms are only used to distinguish one component from another. For example, without departing from the scope of the disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component a not limited by these terms.

Hereinafter, embodiments of the disclosure will be described in detail with reference to the accompanying drawings.

Figure 1:
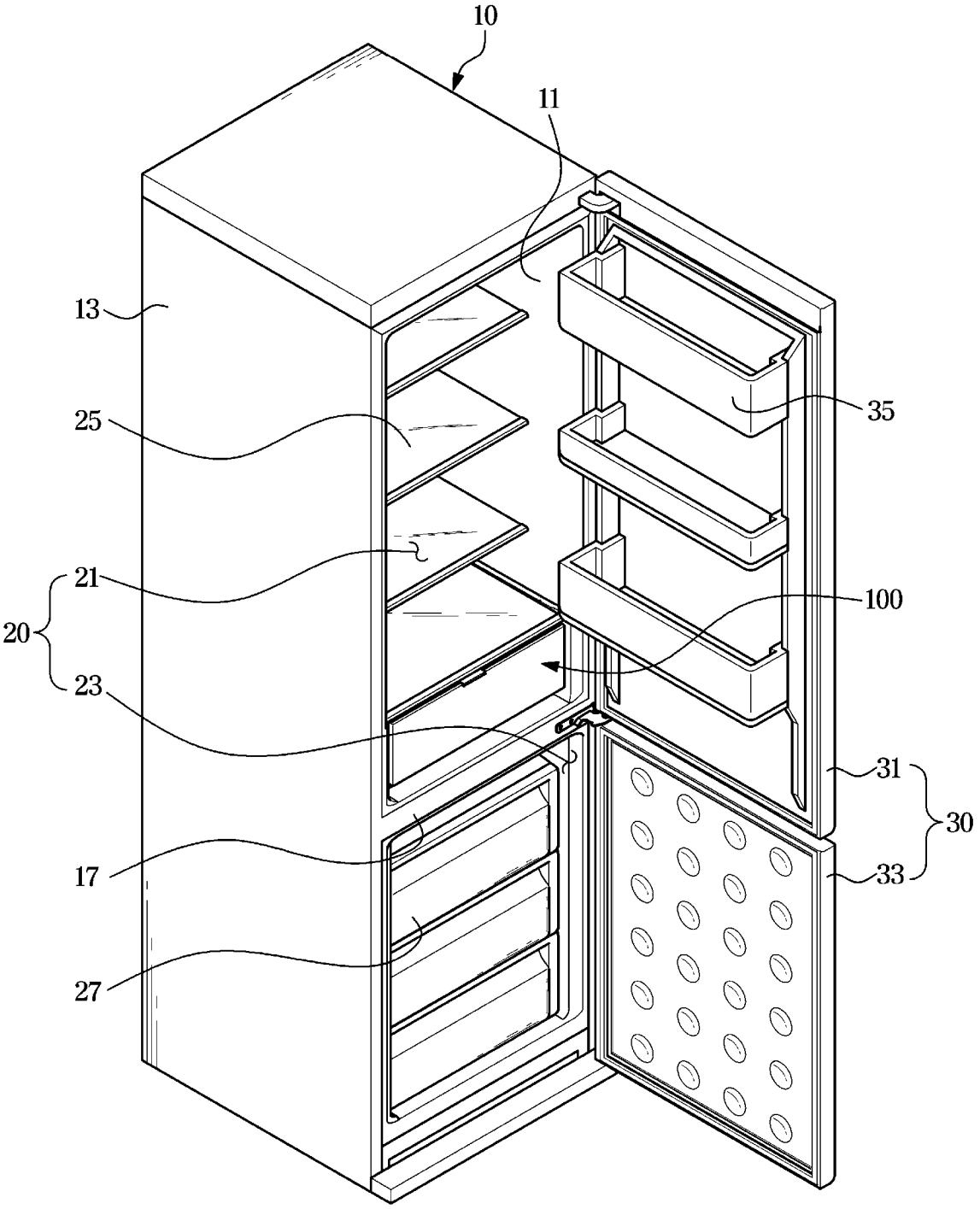
FIG. 1 illustrates a perspective view of a refrigerator according to an embodiment of the disclosure.

FIG. 1 illustrates a perspective view of a refrigerator according to an embodiment of the disclosure.

As illustrated in FIG. 1, a refrigerator may include a main body 10, a storage compartment 20 provided inside the main body 10 and having an open front, and a door 30 opening and closing the open front of the storage compartment 20.

The main body 10 may include an inner case 11 forming the storage compartment 20 and an outer case 13 forming an outer appearance. Insulation 15 may be foamed to prevent cold air in the storage compartment 20 from escaping between the inner case 11 and the outer case 13.

A machine room (not shown) in which a compressor (not shown) for compressing a refrigerant and a condenser (not shown) for condensing the refrigerant compressed by the compressor are installed may be provided at a rear lower side of the main body 10.

The storage compartment 20 may be divided into a refrigerating chamber 21, which is an upper storage chamber, and a refreezing chamber 23, which is a lower storage chamber, by a partition wall 17. Inside the storage compartment 20, a plurality of shelves 25 for stacking and storing food and the like thereon may be provided. Also, a storage box 100 and a storage container 27 for storing food and the like therein may be provided inside the storage compartment 20.

The refrigerating chamber 21 and the refreezing chamber 23 may be opened and closed by a refrigerating chamber door 31 and a refreezing chamber door 33, which are rotatably coupled to the main body 10, respectively, and a plurality of door guards 35 capable of accommodating food and the like may be installed on a rear surface of the door 30.

The refrigerator may include a cold air supply device (not shown) configured to supply cold air to the storage compartment 20. The cold air supply device may include the compressor and the condenser installed in the machine room, an evaporator (not shown) installed on a rear surface of the storage compartment 20 to generate cold air, a blowing fan (not shown) disposed above the evaporator to blow cold air generated from the evaporator to the storage compartment 20, a cold air duct 40 (see FIG. 2) guiding cold air blown by the blowing fan to the storage compartment 20, and the like.

Figure 2:
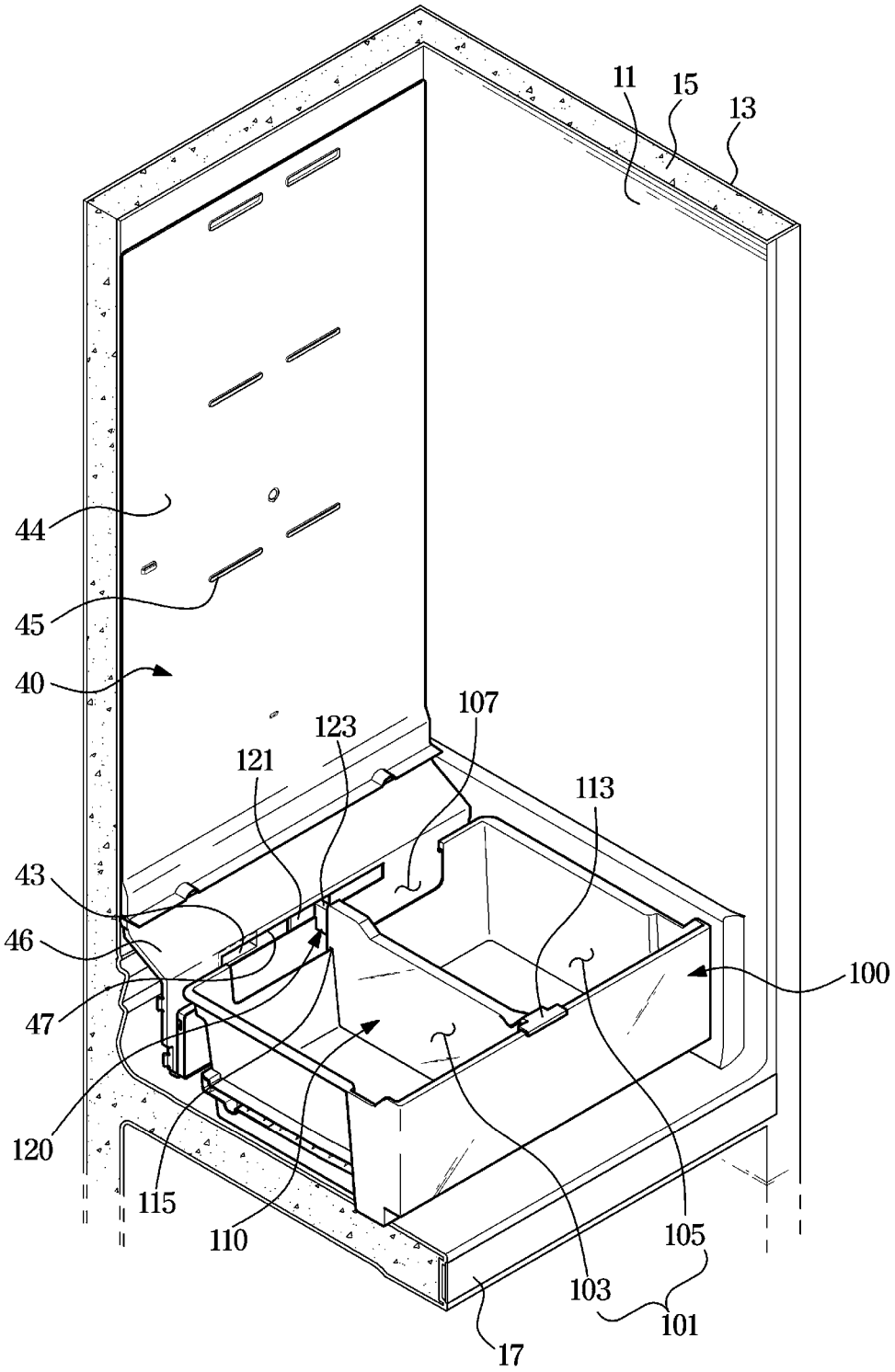
FIG. 2 illustrates a cold air duct and a storage box provided inside a storage compartment according to an embodiment of the disclosure.
Figure 3:
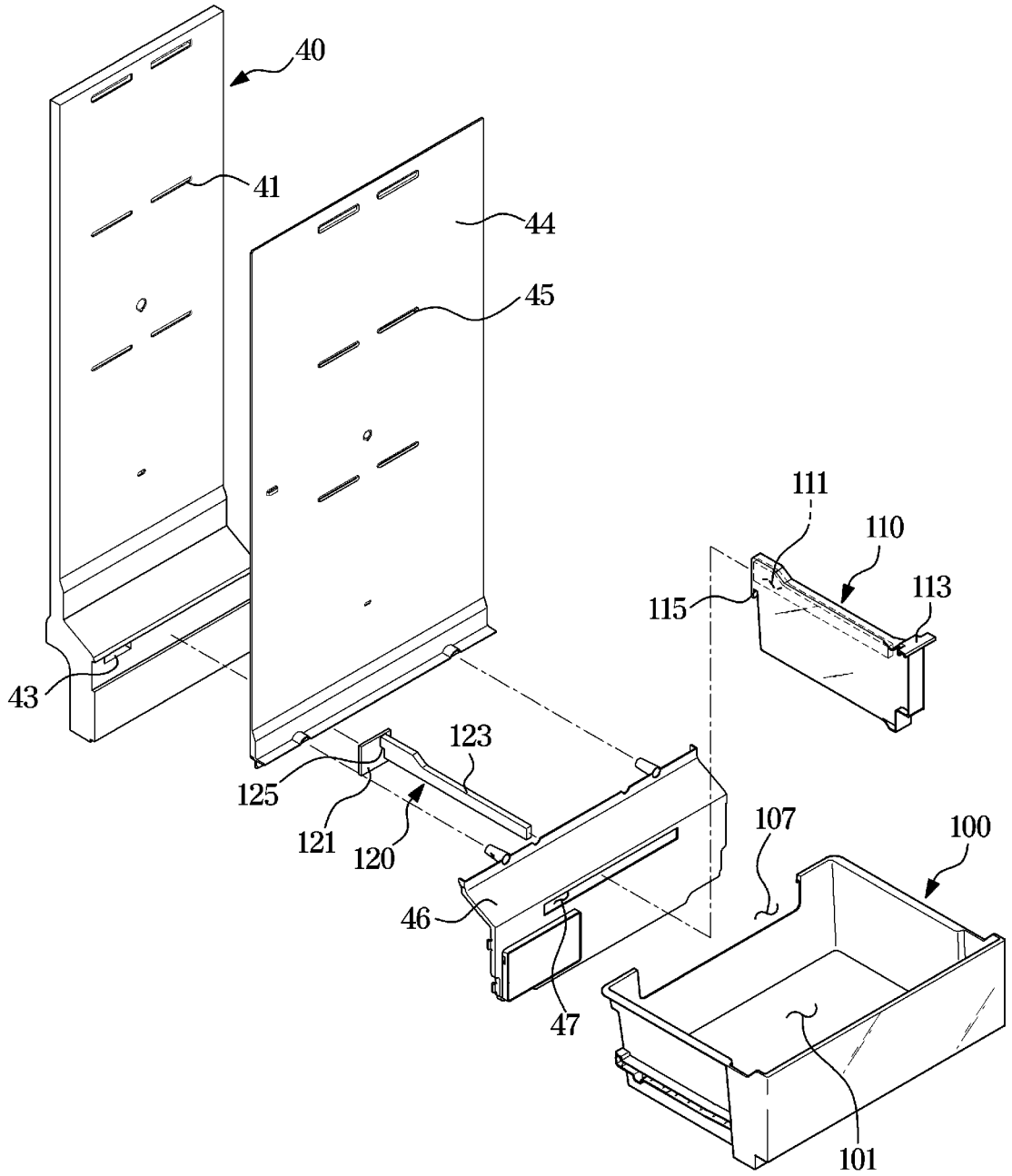
FIG. 3 illustrates an exploded view of the cold air duct and the storage box according to an embodiment of the disclosure.

FIG. 2 illustrates a cold air duct and a storage box provided inside a storage compartment according to an embodiment of the disclosure, and FIG. 3 illustrates an exploded view of the cold air duct and the storage box according to an embodiment of the disclosure.

As illustrated in FIGS. 2 and 3, the cold air duct 40 may be disposed in the rear of the storage compartment 20 to guide cold air generated by the evaporator to the storage compartment 20.

The cold air duct 40 may include a plurality of cold air outlets 41 and 43 to discharge cold air to the storage compartment 20, and cold air duct covers 44 and 46 to cover a front surface of the cold air duct 40.

The plurality of cold air outlets 41 and 43 may include a plurality of the first cold air outlets 41 to discharge cold air to the refrigerating chamber 21, and the second cold air outlet 43 to discharge cold air into a storage space 101 of the storage box 100.

The cold air duct covers 44 and 46 may include the first cold air duct cover 44 covering a front upper portion of the cold air duct 40 and the second cold air duct cover 46 covering a front lower portion of the cold air duct 40. The first cold air duct cover 44 may include a plurality of cold air discharge holes 45 provided at positions corresponding to the plurality of first cold air outlets 41. Cold air discharged from the plurality of first cold air outlets 41 may be discharged into the refrigerating chamber 21 through the plurality of cold air discharge holes 45. The second cold air duct cover 46 may be coupled to the first cold air duct cover 44. The second cold air duct cover 46 may include a guide hole 47 configured to guide such that a connection bar 123 of a cold air adjusting member 120, which will be described later, is moved in the left and right directions. The guide hole 47 may guide such that cold air discharged to the second cold air outlet 43 is discharged into the storage space 101 of the storage box 100. The guide hole 47 may be formed at a height corresponding to the second cold air outlet 43 to guide cold air discharged to the second cold air outlet 43 to the storage space 101. Hereinafter, only the second cold air outlet 43 among the plurality of cold air outlets 41 and 43 will be described, and thus the second cold air outlet 43 will be referred to as a cold air outlet.

The storage box 100 may include the storage space 101 configured to store food and the like therein. The storage space 101 may be divided into a fresh room 103 on the left and a vegetable room 105 on the right by the partition 110. The drawing illustrates that the fresh room 103 is formed on the left of the storage space 101 and the vegetable room 105 is formed on the right of the storage space 101, but the disclosure is not limited thereto. It may be appropriate that the fresh room 103 is maintained at a temperature of about 0 degrees, and it may be appropriate that the vegetable room 105 is maintained at a temperature of about 3 degrees. The partition 110 dividing the storage space 101 into the fresh room 103 and the vegetable room 105 has insulating performance, so that the partition 110 may not be affected even when the fresh room 103 and the vegetable room 105 are maintained at different temperatures. The storage box 100 may include an opening 107 formed on a rear wall thereof. The opening 107 may be provided such that the cold air adjusting member 120 to be moved in the left and right directions together with the partition 110 may be moved in the left and right directions. Cold air discharged from the cold air outlet 43 may be introduced into the storage space 101 through the opening 107.

The cold air outlet 43 may be formed on one side of the cold air duct 40 corresponding to the fresh room 103 such that cold air is introduced into only the fresh room 103 in the storage space 101 of the storage box 100. Because the fresh room 103 needs to be maintained at a temperature of about 0 degrees, the separate cold air outlet 43 for discharging cold air to the fresh room 103 may be required. However, because the vegetable room 105 is maintained at a temperature of about 3 degrees, the vegetable room 105 may be maintained at a temperature of about 0 degrees by cold air discharged to the refrigerating chamber 21 even though cold air is not directly discharged to the vegetable room 105.

The partition 110 may be provided inside the storage box 100 to divide the storage space 101 into the fresh room 103 and the vegetable room 105. The partition 110 may include an insertion hole 111 into which the connection bar 123 of the cold air adjusting member 120, which will be described later, is inserted. The connection bar 123 is slidably inserted into the insertion hole 111 so that the connection bar 123 may be slidably moved in the front and rear directions. The partition 110 may include a first slide moving portion 113 slidably coupled to an upper portion of a front wall of the storage box 100 to be moved in the left and right directions inside the storage space 101, and a second slide moving portion 115 slidably coupled to a lower wall of the opening 107 of the storage box 100. The partition 110 may be provided to be movable in the left and right directions inside the storage box 100 through the first slide moving portion 113 and the second slide moving portion 115.

The cold air adjusting member 120 may be provided to be movable in the left and right directions together with the partition 110. The cold air adjusting member 120 may include an adjusting plate 121 to adjust a size of the cold air outlet 43 by being moved in the left and right directions together with the partition 110, and the connection bar 123 inserted into the insertion hole 111 of the partition 110 to be moved in the left and right directions together with the partition 110.

Because the connection bar 123 is inserted into the insertion hole 111 of the partition 110, the connection bar 123 may be moved together with the partition 110 moved in the left and right directions. The adjusting plate 121 may be connected to the connection bar 123 to be moved in the left and right directions together with the partition 110. Because the connection bar 123 is inserted into the insertion hole 111 of the partition 110 to be slidably moved in the front and rear directions, even when the storage box 100 is drawn out together with the partition 110, the connection bar 123 may be maintained in a state of being connected to the partition 110. That is, the adjusting plate 121 is fixed to adjust the size of the cold air outlet 43, and when the partition 110 is drawn out together with the storage box 100, the connection bar 123 is fixed together with the adjusting plate 121 and the partition 110 may be slidably moved toward the front with respect to the connection bar 123. The connection bar 123 may include a guide portion 125 guided by a guide hole 47 to be movable in the left and right directions together with the partition 110.

Figure 4:
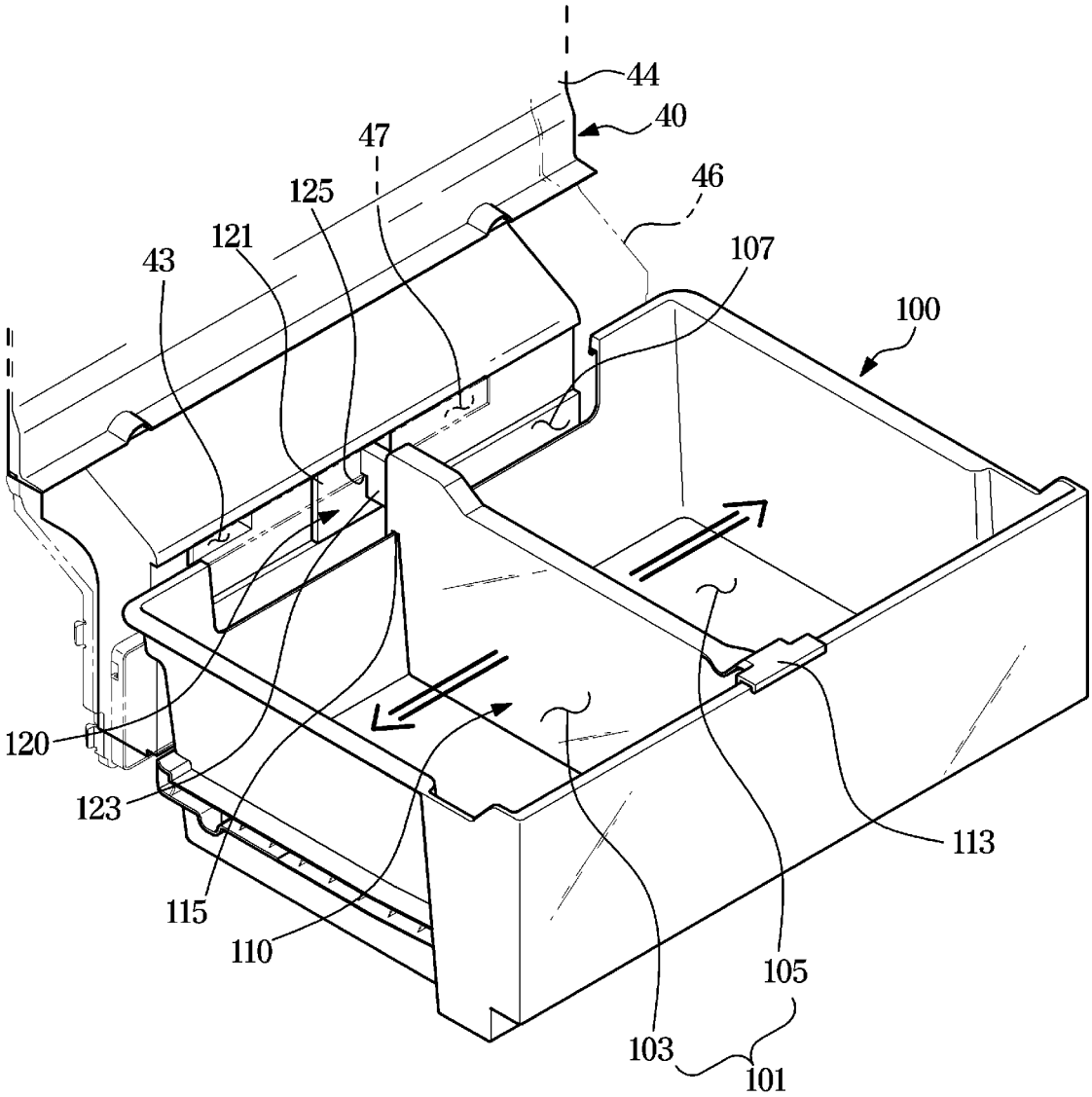
FIG. 4 illustrates that a partition according to an embodiment of the disclosure is moved in the left and right directions inside the storage box.

FIG. 4 illustrates that a partition according to an embodiment of the disclosure is moved in the left and right directions inside the storage box.

As illustrated in FIG. 4, the partition 110 may include the first slide moving portion 113 slidably and movably coupled to the front wall of the storage box 100, and the second slide moving portion 115 slidably and movably coupled to the lower wall of the opening 107 formed in the rear wall of the storage box 100. The partition 110 may be coupled to the storage box 100 to be slidably movable in the left and right directions in the storage box 100 through the first slide moving portion 113 and the second slide moving portion 115. Because the guide portion 125 of the connection bar 123 is guided by the guide hole 47 to be movable in the left and right directions, the cold air adjusting member 120 may be moved in the left and right directions together with the partition 110. The cold air adjusting member 120 may be moved in the left and right directions together with the partition 110 to adjust the size of the cold air outlet 43. A description thereof will be given later.

Figure 5:
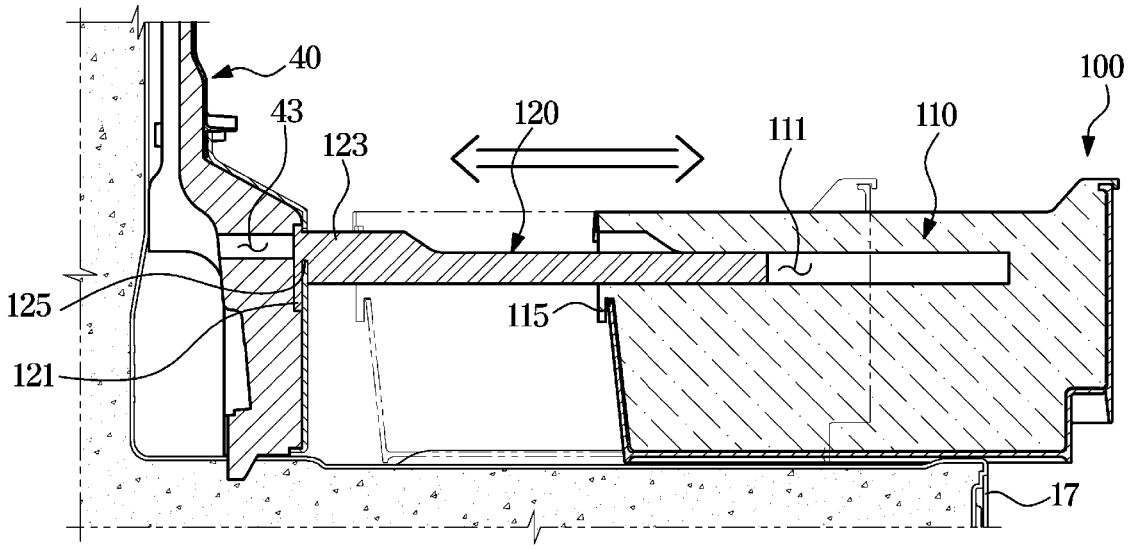
FIG. 5 illustrates that a cold air adjusting member is maintained in a state of being connected to the partition when the storage box according to an embodiment of the disclosure is drawn out.

FIG. 5 illustrates that a cold air adjusting member is maintained in a state of being connected to the partition when the storage box according to an embodiment of the disclosure is drawn out.

As illustrated in FIG. 5, when the storage box 100 is drawn out, the partition 110 may also be drawn out together with the storage box 100. Even when the partition 110 is drawn out, the adjusting plate 121 of the cold air adjusting member 120 may be fixed to be able to adjust the size of the cold air outlet 43. That is, because a size of the adjusting plate 121 is larger than that of the guide hole 47, the adjusting plate 121 may be fixed not to be moved forward by the guide hole 47 even when the partition 110 is drawn out forward. The connection bar 123 connected to the adjusting plate 121 may also be maintained in a state of being fixed together with the adjusting plate 121. Because the connection bar 123 is inserted into the insertion hole 111 to be slidably movable in the left and right directions, when the partition 110 is drawn out forward, the connection bar 123 may be fixed, and the partition 110 may be slidably movable forward with respect to the connection bar 123. Therefore, even when the storage box 100 is drawn out, the cold air adjusting member 120 and the partition 110 may be maintained in a state of being connected to each other.

Figure 6:
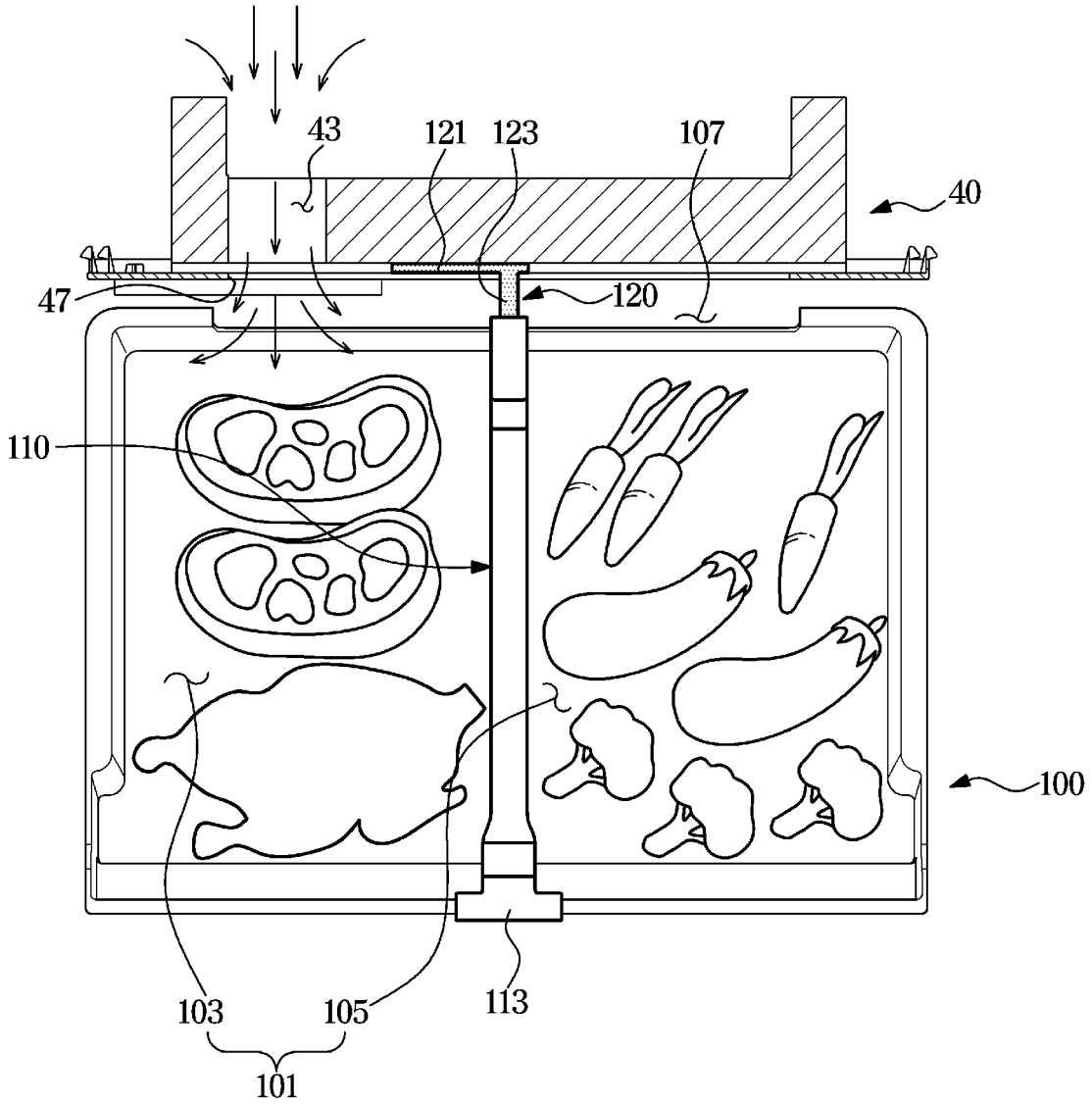
FIG. 6 illustrates that the partition according to an embodiment of the disclosure is positioned in a central portion of a storage space.
Figure 7:
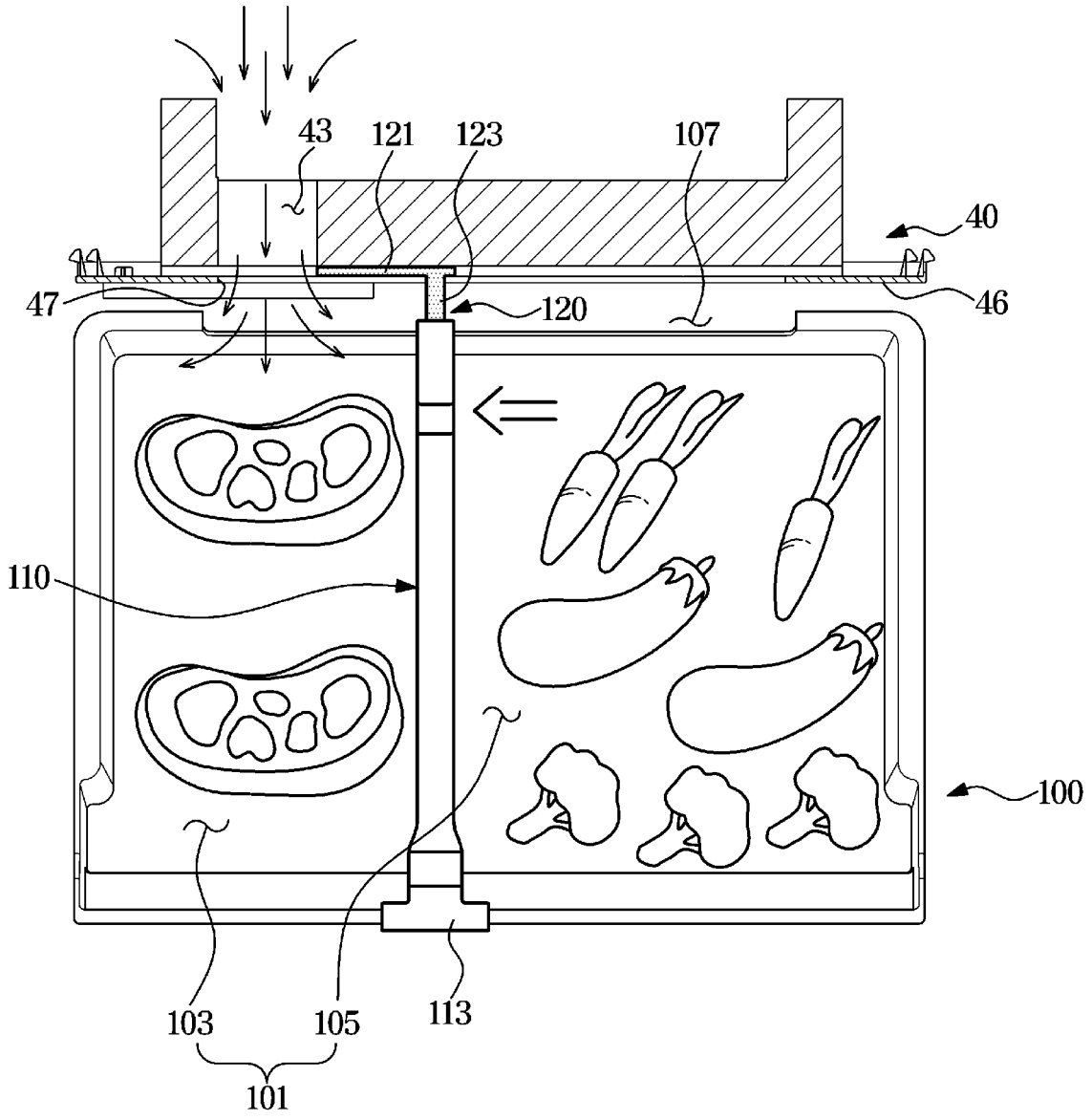
FIG. 7 illustrates that the partition is moved to a first position to the left from the position in FIG. 6.
Figure 8:
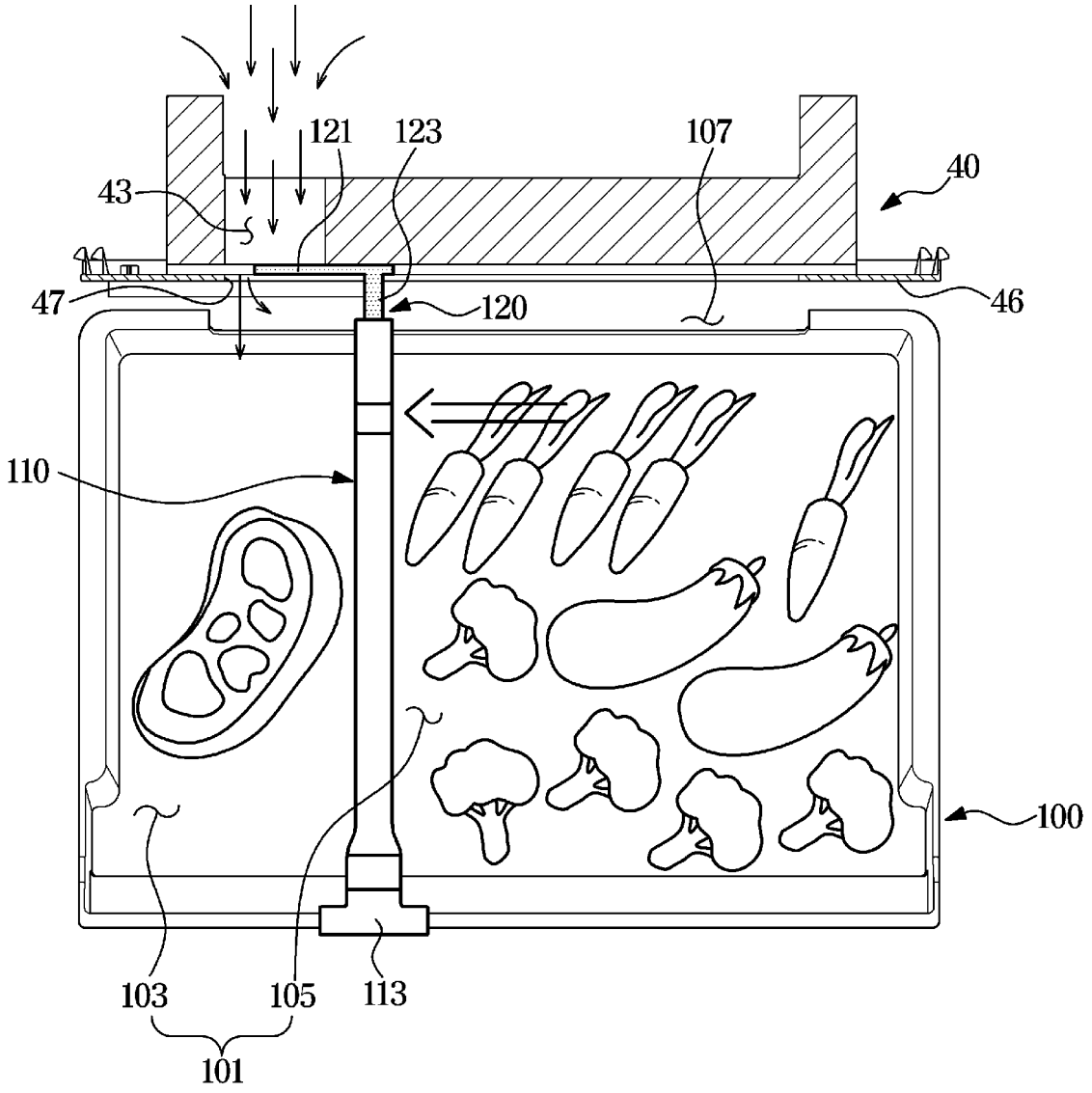
FIG. 8 illustrates that the partition is moved to a second position to the left from the position in FIG. 7.

FIG. 6 illustrates that the partition according to an embodiment of the disclosure is positioned in a central portion of a storage space, FIG. 7 illustrates that the partition is moved to a first position to the left from the position in FIG. 6, and FIG. 8 illustrates that the partition is moved to a second position to the left from the position in FIG. 7.

As illustrated in FIG. 6, the fresh room 103 on the left and the vegetable room 105 on the right in the storage space 101 of the storage box 100 may stole other foods suitable for temperature, respectively. In this case, cold air discharged from the cold air outlet 43 may be introduced into the fresh room 103 so that the fresh room 103 and the vegetable room 105 may be maintained at a temperature of about 0 degrees.

As illustrated in FIG. 7, when an amount of food to be stored in the vegetable room 105 is larger than the amount of food to be stored in the fresh room 103, a size of the fresh room 103 may be decreased by moving the partition 110 to the left. That is, by moving the partition 110 in the left direction where the size of the fresh room 103 becomes small, the size of the fresh room 103 may be decreased and a size of the vegetable room 105 may be increased. In this case, though the size of the fresh room 103 is decreased while the partition 110 is moved to a first position, which is a position before the adjusting plate 121 closes the cold air outlet 43, cold air may be discharged from the entire cold air outlet 43 to maintain the fresh room 103 at a temperature of 0 degrees.

As illustrated in FIG. 8, when an amount of food to be stored in the vegetable room 105 becomes large, the partition 110 may be moved from the first position to a second position where the adjusting plate 121 closes a portion of the cold air outlet 43. When the partition 110 is moved from the first position to the left to be positioned at the second position, the size of the fresh room 103 may be significantly decreased than that when the partition 110 is in the first position. When the size of the fresh room 103 becomes too small, too much cold air may be discharged to the fresh room 103 so that the temperature of the fresh room 103 is not maintained at about 0 degrees and may be lower than that. At this time, when the adjusting plate 121 closes a portion of the cold air outlet 43, an amount of cold air discharged to the fresh room 103 is decreased so that the fresh room 103 may continue to be maintained at a temperature of about 0 degrees. That is, the size of the cold air outlet 43 is automatically adjusted by the adjusting plate 121 according to the size change of the fresh room 103 so that food may be stored at a good temperature for storing food without additional temperature control.

Figure 9:
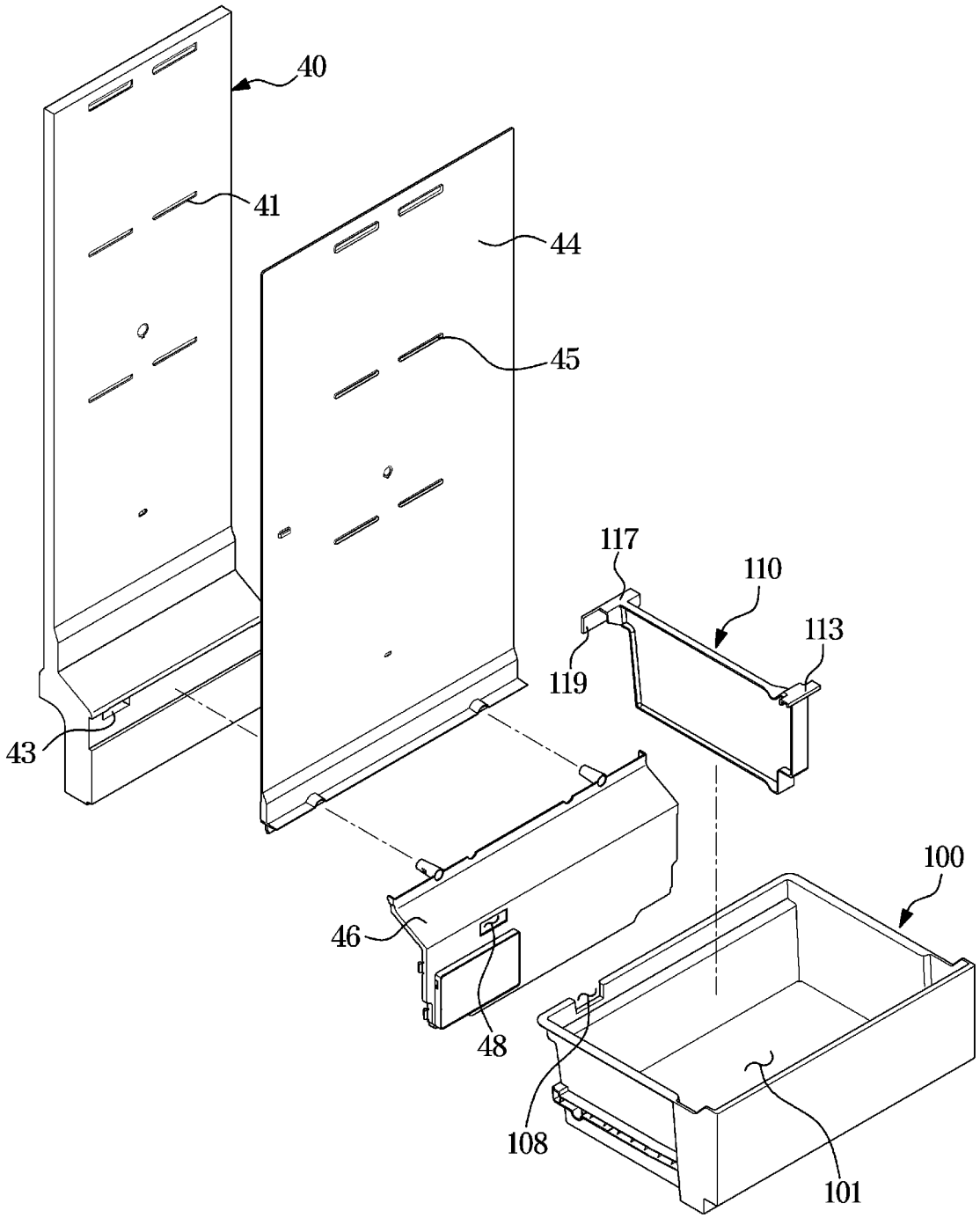
FIG. 9 is an exploded view of a cold air duct and a storage box according to another embodiment of the disclosure.
Figure 10:
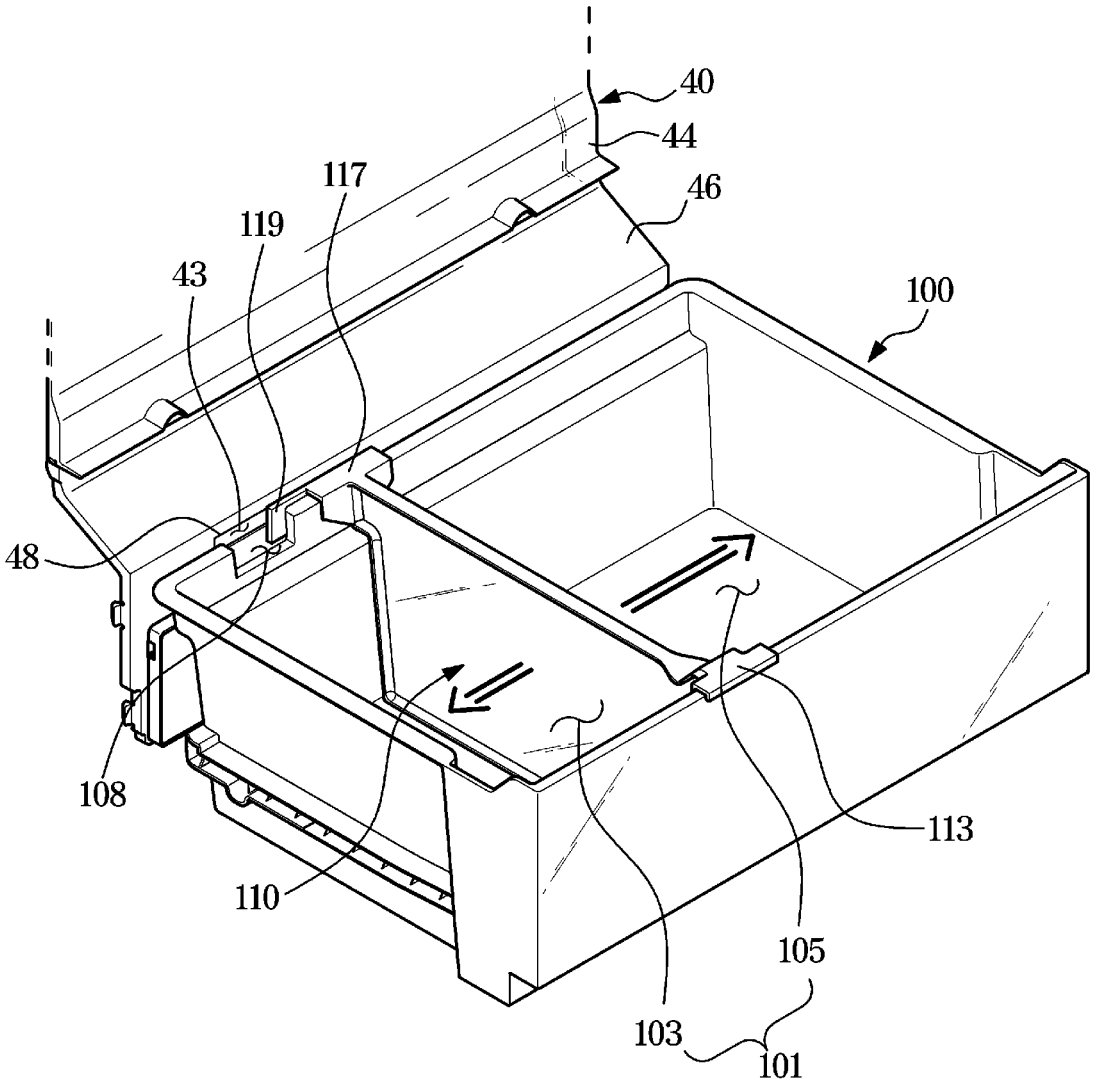
FIG. 10 illustrates that a partition according to another embodiment of the disclosure is moved in the left and right directions inside the storage box.

FIG. 9 is an exploded view of a cold air duct and a storage box according to another embodiment of the disclosure, and FIG. 10 illustrates that a partition according to another embodiment of the disclosure is moved in the left and right directions inside the storage box.

As illustrated in FIGS. 9 and 10, the storage space 101 in the storage box 100 may be divided into the fresh room 103 on the left and the vegetable room 105 on the right by the partition 110. When comparing the configuration illustrated in FIGS. 9 and 10 with the configuration illustrated in FIG. 3, the cold air adjusting member 120 for adjusting the size of the cold air outlet 43 may not be provided. That is, an adjusting plate 119 for adjusting the size of the cold air outlet 43 may be integrally formed with the partition 110, and the connection bar 123 may be removed. Therefore, a description of the same configuration as that illustrated in FIG. 3 is omitted, and only the changed configuration will be described.

A guide hole 48 for guiding cold air discharged from the cold air outlet 43 to be introduced into the fresh room 103 may be formed at a position corresponding to the cold air outlet 43. The guide hole 48 may have a size corresponding to the cold air outlet 43. This is because the guide hole 48 only needs to guide the cold air discharged from the cold air outlet 43 to the fresh room 103 without guiding the movement of the connection bar 123 in the left and right directions as the configuration of the connection bar 123 illustrated in FIG. 3 is removed.

The opening 108 formed on the rear wall of the storage box 100 may also be formed at a position corresponding to the cold air outlet 43. This is because the movement of the connection bar 123 in the left and right directions need not be guided as the configuration of the connection bar 123 illustrated in FIG. 3 is removed.

The partition 110 may include the first slide moving portion 113 slidably and movably coupled to the front wall of the storage box 100, and a second slide moving portion 117 slidably and movably coupled to the rear wall of the storage box 100. That is, the partition 110 may be slidably and movably coupled in the left and right directions in the storage box 100 through the first slide moving portion 113 and the second slide moving portion 117. The partition 110 may include the adjusting plate 119 moving in the left and right directions to adjust the size of the cold air outlet 43.

Because the configuration of the adjusting plate 119 integrally formed with the partition 110 is the same as the configuration in which the size of the cold air outlet 43 is adjusted according to the movement of the partition 110 illustrated in FIGS. 6 to 8 except for a configuration in which the adjusting plate 119 adjusts the size of the cold air outlet 43 according to the movement of the partition 110 in the left and right directions, a description thereof is omitted.

Figure 11:
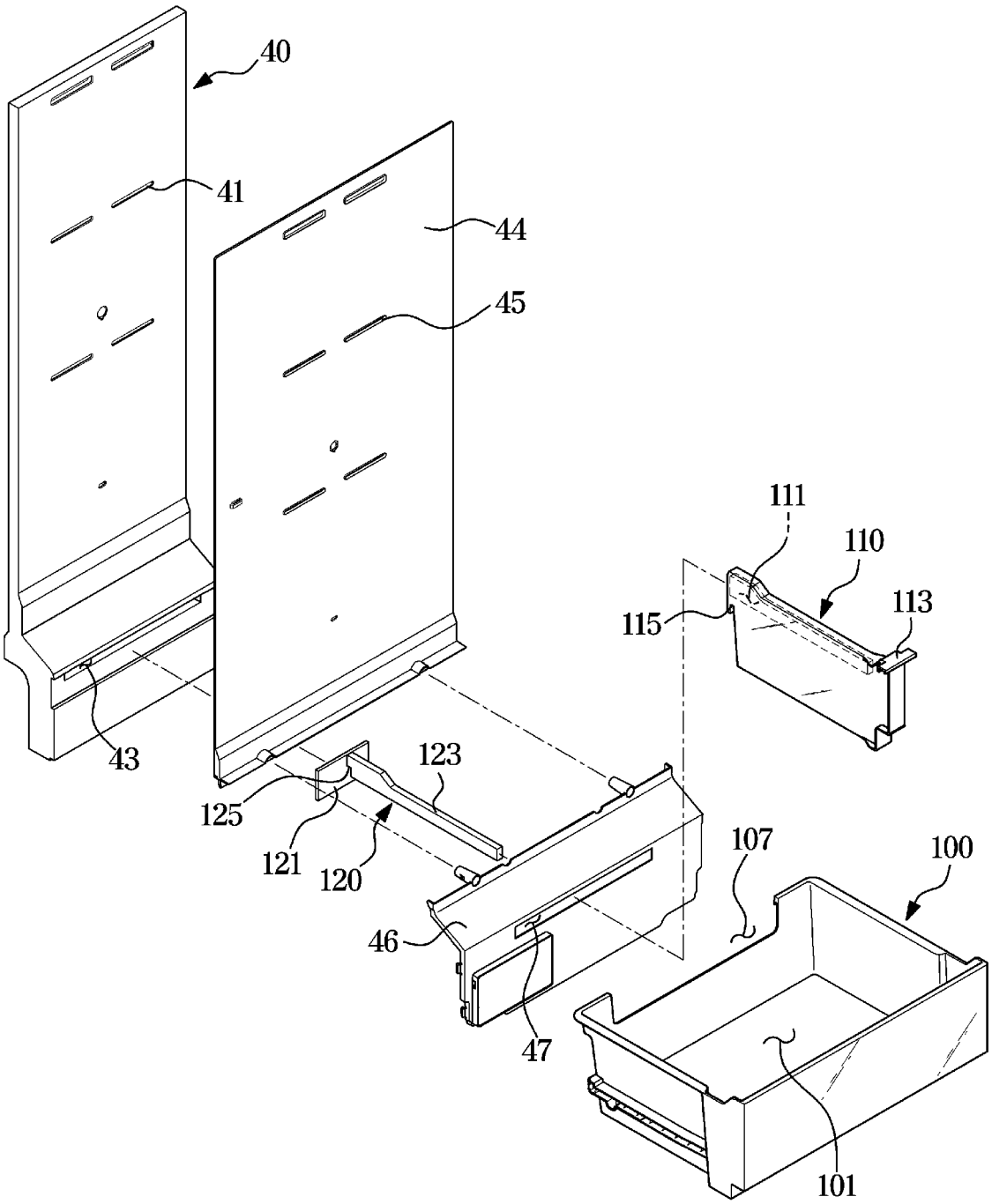
FIG. 11 illustrates an exploded view of a cold air duct and a storage box according to another embodiment of the disclosure.
Figure 12:
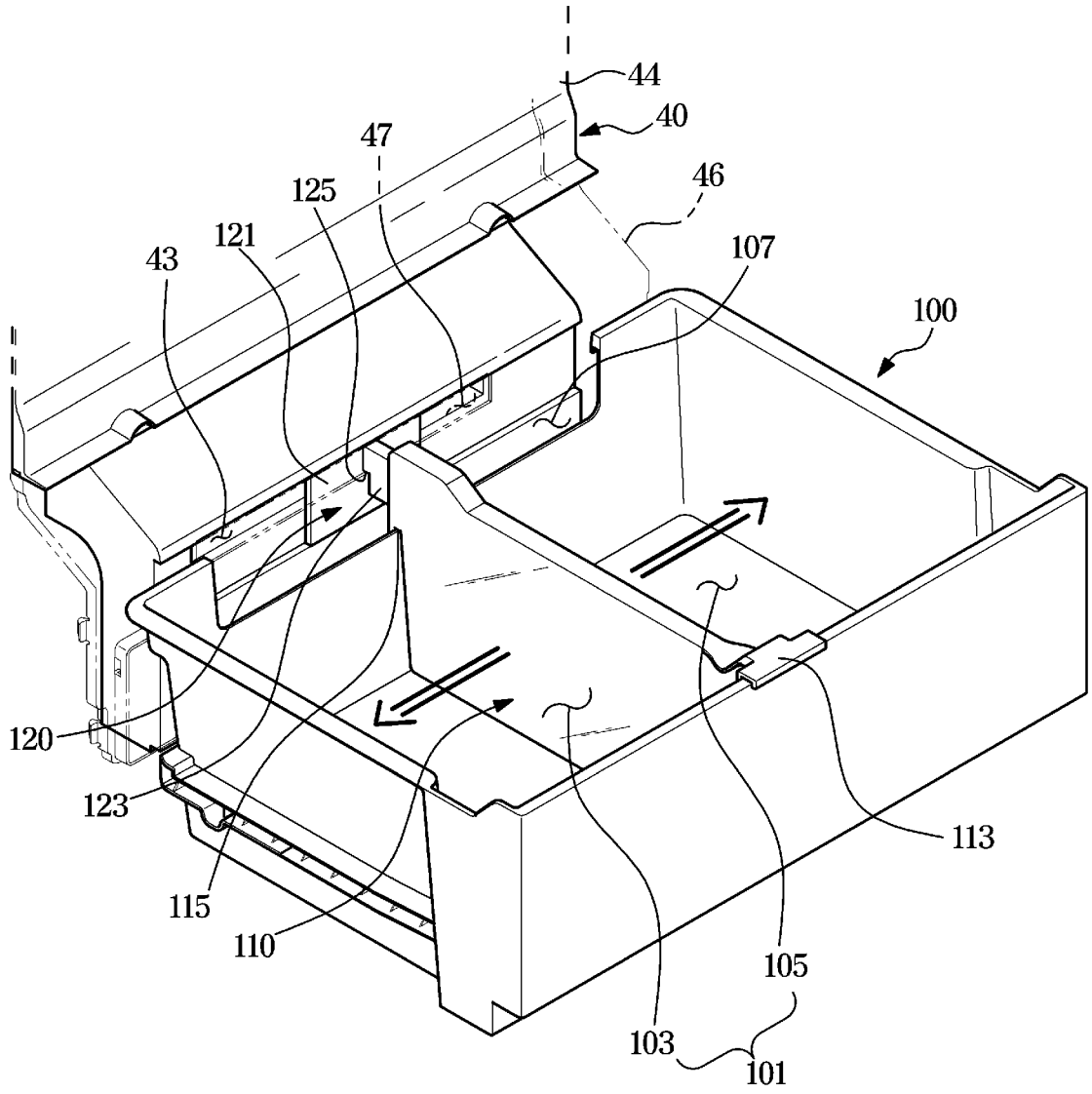
FIG. 12 illustrates that a partition according to another embodiment of the disclosure is moved in the left and right directions inside the storage box.

FIG. 11 illustrates an exploded view of a cold air duct and a storage box according to another embodiment of the disclosure, and FIG. 12 illustrates that a partition according to another embodiment of the disclosure is moved in the left and right directions inside the storage box.

As illustrated in FIGS. 11 and 12, the storage space 101 in the storage box 100 may be divided into the fresh room 103 on the left and the vegetable room 105 on the right by the partition 110. When comparing the configuration illustrated in FIGS. 10 and 12 with the configuration illustrated in FIG. 3, both configurations may be the same except for the configuration of the cold air outlet 43 formed on the cold air duct 40. Therefore, a description of the same configuration is omitted, and only the configuration of the cold air outlet 43 will be described.

The cold air outlet 43 may be formed to have a length in the left and right directions of the cold air duct 40 to discharge cold air to both the fresh room 103 and the vegetable room 105. That is, the cold air outlet 43 may be formed in the shape of slit extending in the left and right directions. When the cold air outlet 43 is formed in the shape of slit extending in the left and right directions, the amount of cold air discharged to the fresh room 103 and the vegetable room 105 may be adjusted, respectively, according to size changes of the fresh room 103 and the vegetable room 105.

Figure 13:
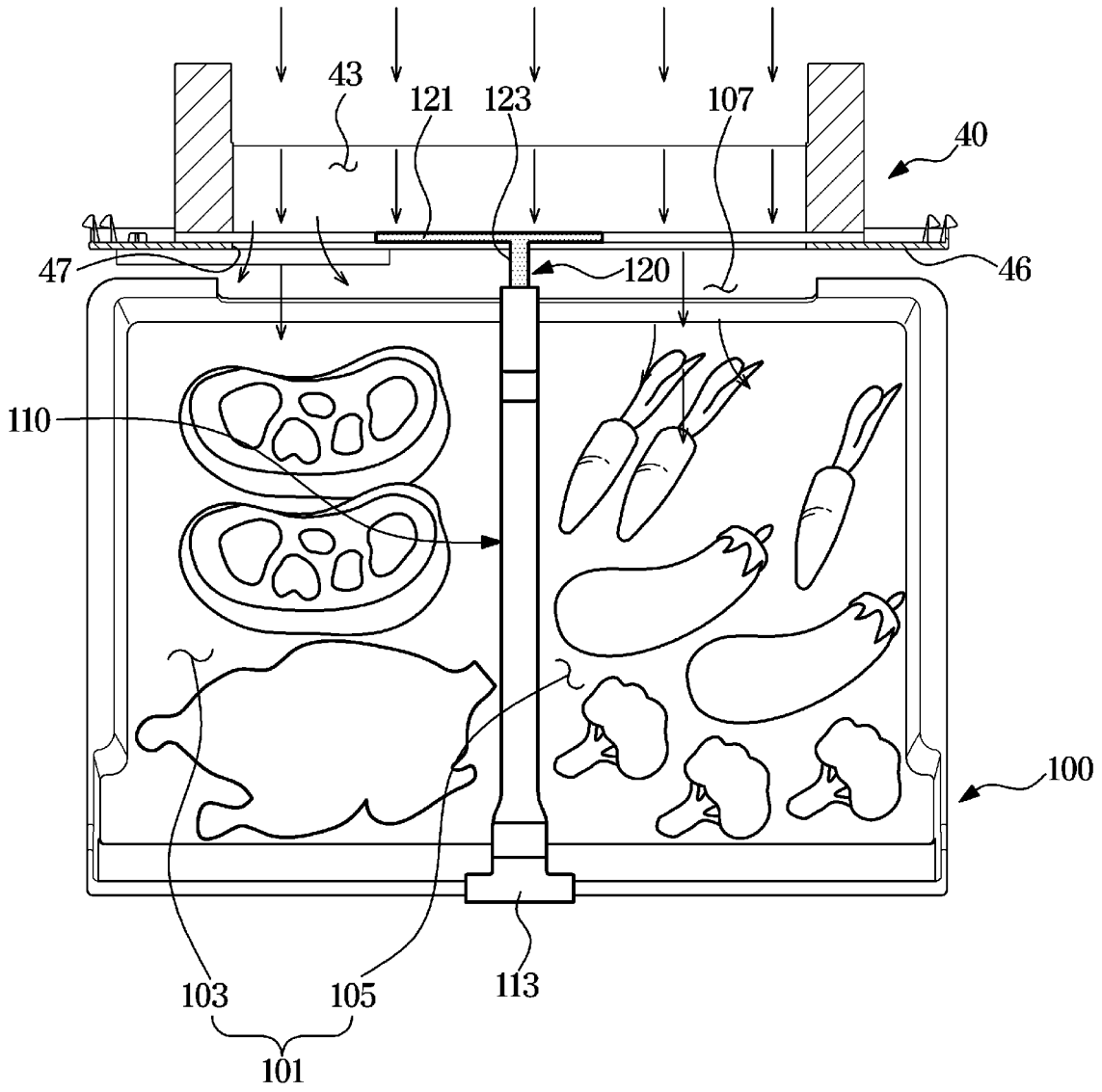
FIG. 13 illustrates that the partition illustrated in FIG. 12 is positioned in a central portion of a storage space.
Figure 14:
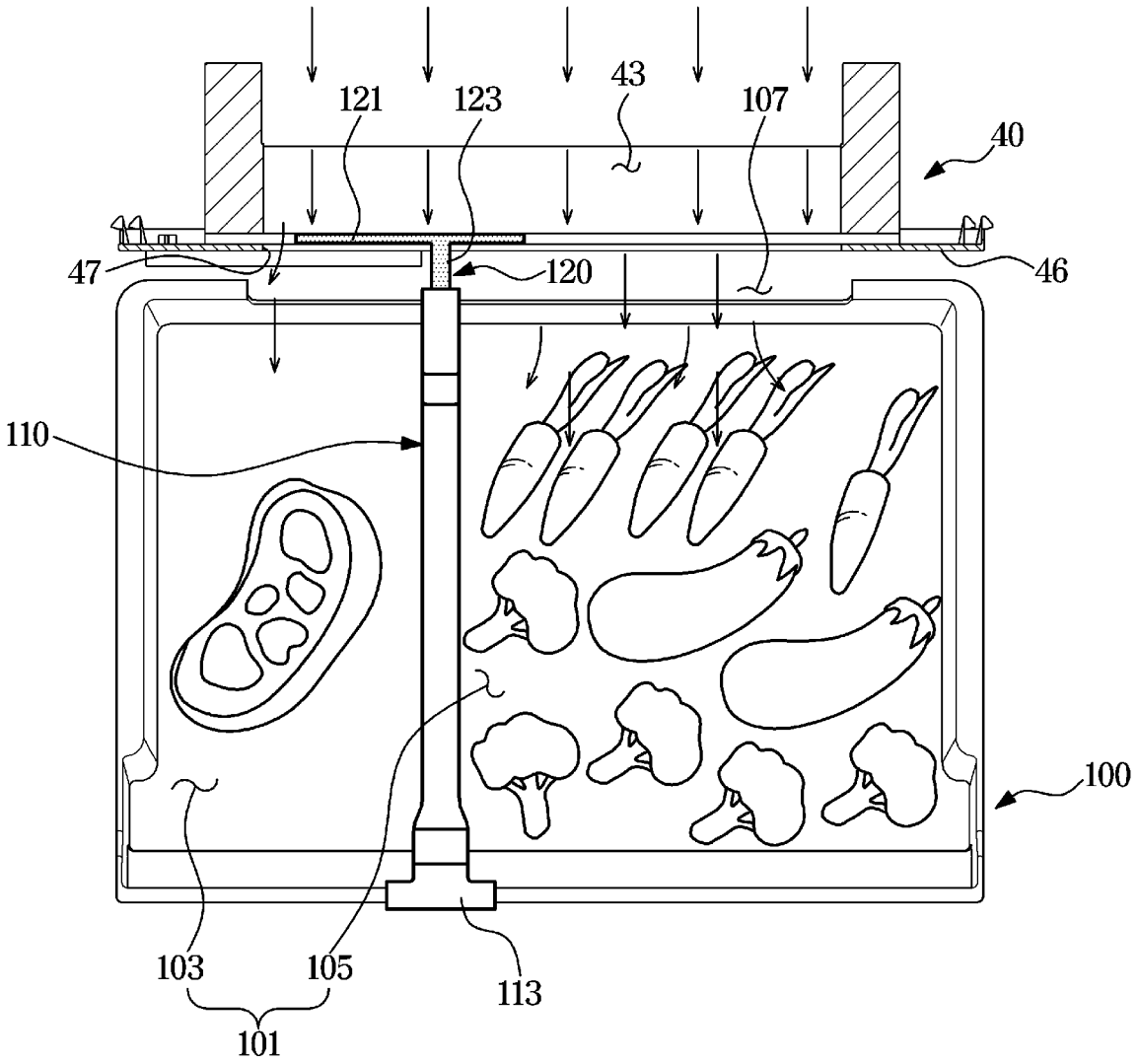
FIG. 14 illustrates that the partition is moved to the left from the position in FIG. 13.
Figure 15:
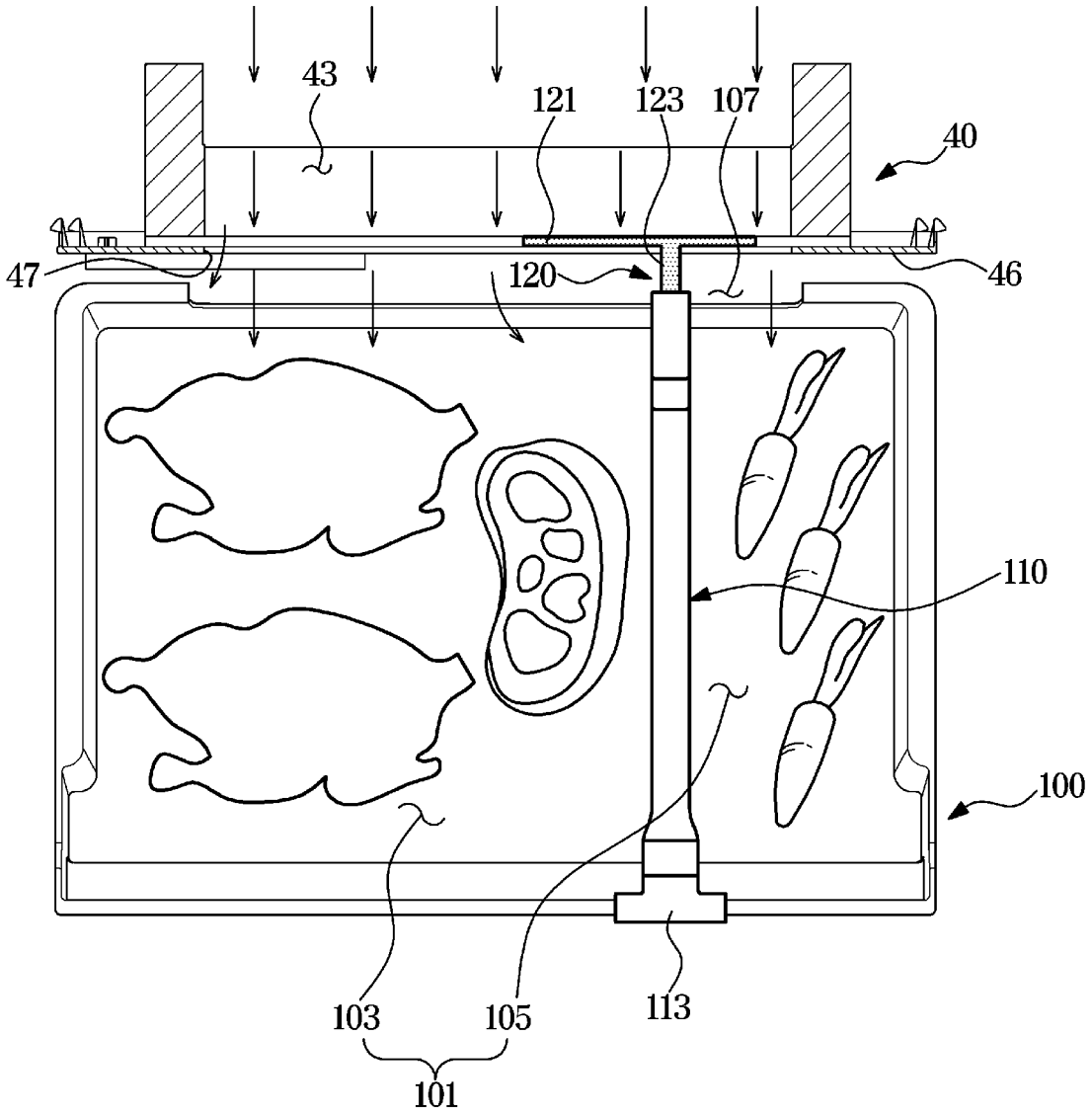
FIG. 15 illustrates that the partition is moved to the right from the position in FIG. 13.

FIG. 13 illustrates that the partition illustrated in FIG. 12 is positioned in a central portion of a storage space, FIG. 14 illustrates that the partition is moved to the left from the position in FIG. 13, and FIG. 15 illustrates that the partition is moved to the right from the position in FIG. 13.

As illustrated in FIG. 13, the fresh room 103 on the left and the vegetable room 105 on the right in the storage space 101 of the storage box 100 may stole other foods suitable for temperature, respectively. In this case, cold air discharged from the cold air outlet 43 may be introduced into the fresh room 103 and the vegetable room 105 so that the fresh room 103 and the vegetable room 105 may be maintained at a temperature of about 0 degrees and a temperature of about 3 degrees, respectively.

As illustrated in FIG. 14, when the amount of food to be stored in the vegetable room 105 is larger than the amount of food to be stored in the fresh room 103, the size of the fresh room 103 may be decreased by moving the partition 110 to the left. That is, by moving the partition 110 in the left direction where the size of the fresh room 103 becomes small, the size of the fresh room 103 may be decreased and the size of the vegetable room 105 may be increased. In this case, the size of the cold air outlet 43 allowing cold air to be discharged to the fresh room 103 may be decreased by the adjusting plate 119 that is moved to the left direction together with the partition 110. Also, the size of the cold air outlet 43 allowing cold air to be discharged to the vegetable room 105 may be increased. That is, the size of the cold air outlet 43 allowing cold air to be discharged to the fresh room 103 and the vegetable room 105 may be adjusted in proportion to the size change of the fresh room 103 and the vegetable room 105. Therefore, the amount of cold air discharged to the fresh room 103 may be decreased, and the amount of cold air discharged to the vegetable room 105 may be increased.

As illustrated in FIG. 15, when the amount of food to be stored in the fresh room 103 is larger than the amount of food to be stored in the vegetable room 105, the size of the fresh room 103 may be increased by moving the partition 110 to the right. That is, by moving the partition 110 in the right direction where the size of the fresh room 103 becomes large, the size of the fresh room 103 may be increased and the size of the vegetable room 105 may be decreased. In this case, the size of the cold air outlet 43 allowing cold air to be discharged to the fresh room 103 may be increased by the adjusting plate 119 that is moved to the right direction together with the partition 110. Also, the size of the cold air outlet 43 allowing cold air to be discharged to the vegetable room 105 may be decreased. That is, the size of the cold air outlet 43 allowing cold air to be discharged to the fresh room 103 and the vegetable room 105 may be adjusted in proportion to the size changes of the fresh room 103 and the vegetable room 105. Therefore, the amount of cold air discharged to the fresh room 103 may be increased, and the amount of cold air discharged to the vegetable room 105 may be decreased.

Figure 16:
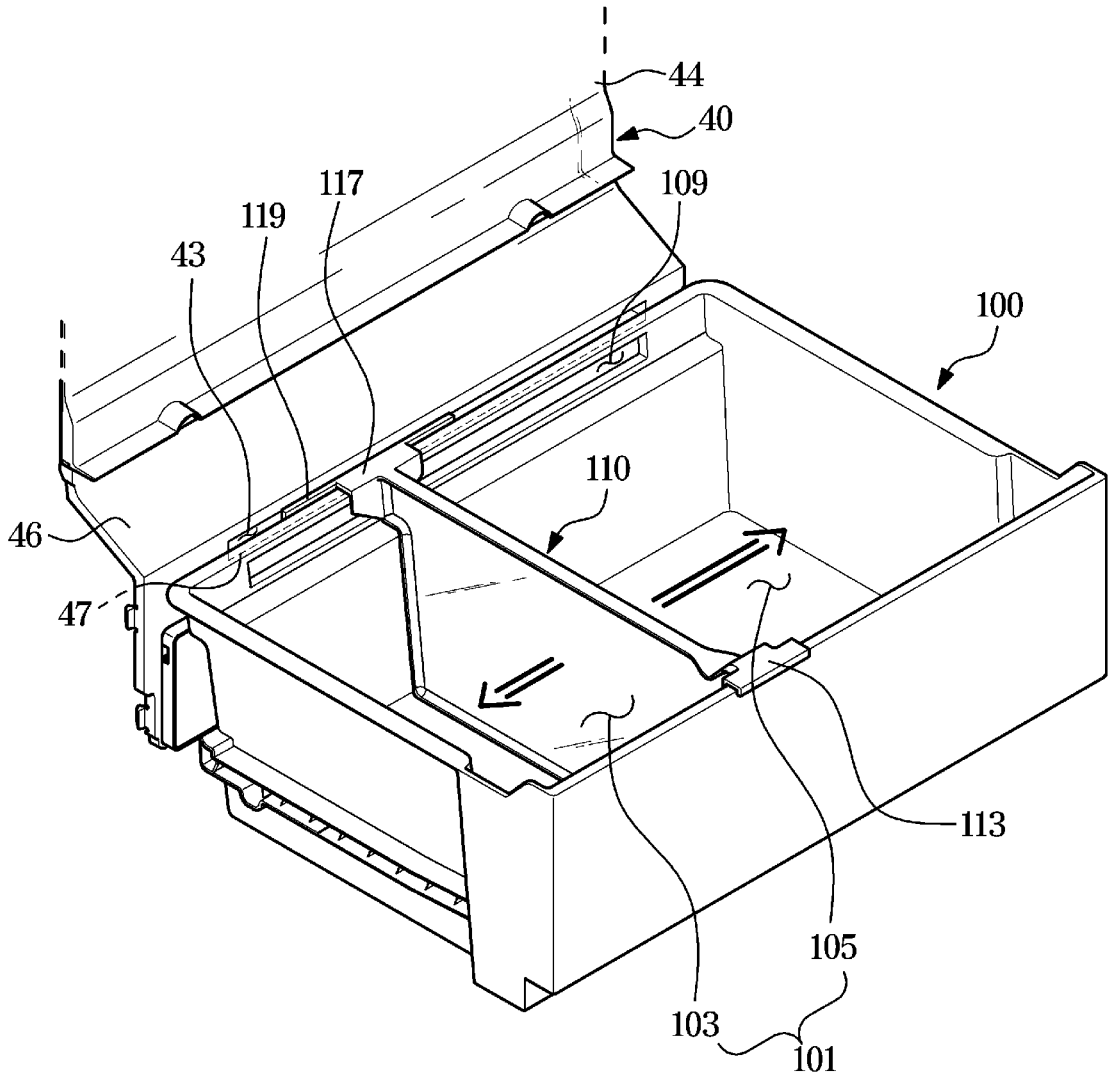
FIG. 16 illustrates that a partition according to another embodiment of the disclosure is moved in the left and right directions inside the storage box.

FIG. 16 illustrates that a partition according to another embodiment of the disclosure is moved in the left and right directions inside the storage box.

As illustrated in FIG. 16, the storage space 101 in the storage box 100 may be divided into the fresh room 103 on the left and the vegetable room 105 on the right by the partition 110. When comparing the configuration illustrated in FIG. 16 with the configuration illustrated in FIG. 11, the cold air adjusting member 120 for adjusting the size of the cold air outlet 43 may not be provided. That is, an adjusting plate 119 for adjusting the size of the cold air outlet 43 may be integrally formed with the partition 110, and the connection bar 123 may be removed. Therefore, as in the case of explaining the configuration illustrated in FIG. 11, a description of the same configuration is omitted, and only the changed configuration will be described. The configuration changed compared to the configuration illustrated in FIG. 11 is only the configuration of the opening 109 formed on the rear wall of the storage box 100.

The opening 109 formed on the rear wall of the storage box 100 may be formed at a position corresponding to the guide hole 47. Also, the opening 109 may be formed to have a size corresponding to the guide hole 47. This is because the configuration of the connection bar 123 illustrated in FIG. 11 is removed, and thus the movement of the connection bar 123 in the left and right directions need not be guided and it is sufficient if only cold air discharged through the guide hole 47 is discharged to the storage space 101 in the storage box 100.

Because the configuration of the adjusting plate 119 integrally formed with the partition 110 is the same as the configuration in which the size of the cold air outlet 43 is adjusted according to the movement of the partition 110 illustrated in FIGS. 13 to 15 except for a configuration in which the adjusting plate 119 adjusts the size of the cold air outlet 43 according to the movement of the partition 110 in the left and right directions, a description thereof is omitted.

As is apparent from the above, according to the embodiments of the disclosure, a fresh room and a vegetable room can be maintained at a predetermined temperature while sizes of the fresh room and the vegetable room can be adjusted to be suitable for an amount of food stored in the fresh room and the vegetable room, respectively, thereby improving user convenience.

While the disclosure has been particularly described with reference to exemplary embodiments, it should be understood by those of skilled in the art that various changes in form and details may be made without departing from the spirit and scope of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a main body;

a storage compartment provided in the main body and having an open front side;

a storage box configured to be drawn out of or put into the storage compartment and having a storage space therein;

a cold air duct provided at a rear of the storage compartment and comprising a cold air outlet configured to discharge cold air into the storage space;

a partition disposed in the storage box, the partition configured to divide the storage space into a fresh room and a vegetable room and to be movable in a left direction and a right direction in the storage space; and a cold air adjusting member configured to be moved in the left direction and the right direction together with the partition to adjust a size of the cold air outlet, the cold air adjusting member configured to remain connected to the partition when the storage box is drawn out.

2. The refrigerator according to claim 1, wherein the cold air adjusting member comprises:

an adjusting plate configured to adjust the size of the cold air outlet; and a connection bar connected to the adjusting plate and provided to be slidably moved in a front direction and a rear direction with respect to the partition.

3. The refrigerator according to claim 2, wherein the partition comprises an insertion hole through which the connection bar is slidably movable in the front direction and the rear direction.

4. The refrigerator according to claim 3, wherein:

the cold air duct comprises a cold air duct cover configured to cover a front surface of the cold air duct, and the cold air duct cover comprises:

a first cold air duct cover configured to cover an upper front of the cold air duct, and a second cold air duct cover coupled to a lower portion of the first cold air duct cover and configured to cover a lower front of the cold air duct.

5. The refrigerator according to claim 4, wherein the second cold air duct cover comprises a guide hole configured to guide the connection bar to be moved in the left direction and the right direction and to allow cold air discharged to the cold air outlet to be introduced into the storage space.

6. The refrigerator according to claim 5, wherein the connection bar comprises a guide portion guided by the guide hole.

7. The refrigerator according to claim 6, wherein the cold air outlet is formed on one side of the cold air duct at a position corresponding to the fresh room such that cold air is discharged only to the fresh room in the storage space.

8. The refrigerator according to claim 7, wherein, when the partition is moved in a direction in which a size of the fresh room decreases together with the cold air adjusting member, cold air is discharged from an entirety of the cold air outlet to the fresh room while the partition is being moved to a first position, wherein the first position is a position before the adjusting plate closes the cold air outlet.

9. The refrigerator according to claim 8, wherein, when the partition is further moved from the first position in the direction in which the size of the fresh room decreases so that the partition is moved to a second position where a portion of the cold air outlet is closed by the adjusting plate, an amount of cold air discharged from the cold air outlet to the fresh room is decreased.

10. The refrigerator according to claim 6, wherein the cold air outlet has a length extending in the left direction and the right direction of the cold air duct such that cold air is discharged to both the fresh room and the vegetable room.

11. The refrigerator according to claim 10, wherein a portion of the cold air outlet closed by the adjusting plate is configured to be adjusted according to a position of the partition so that an amount of cold air discharged to the fresh room and the vegetable room is adjusted.

12. The refrigerator according to claim 11, wherein, when the partition is moved in a direction in which a size of the vegetable room decreases, the cold air outlet is configured to be adjusted in size by the adjusting plate so that a portion for allowing cold air to be discharged to the vegetable room decreases and a portion for allowing cold air to be discharged to the fresh room increases.

13. The refrigerator according to claim 11, wherein, when the partition is moved in a direction in which a size of the fresh room decreases, the cold air outlet is configured to be adjusted in size by the adjusting plate so that a portion for allowing cold air to be discharged to the fresh room decreases and a portion for allowing cold air to be discharged to the vegetable room increases.

14. The refrigerator according to claim 1, wherein the storage box comprises an opening formed in a rear wall thereof, the opening configured to allow the cold air adjusting member to be movable in the left direction and the right direction together with the partition.

15. The refrigerator according to claim 14, wherein the partition comprises:

a first slide moving portion coupled to an upper portion of a front wall of the storage box and configured to be slidably movable in the left direction and the right direction; and a second slide moving portion coupled to a lower wall of the opening and configured to be slidably movable.

16. A refrigerator comprising:

a main body;

a storage compartment provided in the main body and having an open front side;

a storage box configured to be drawn out of or put into the storage compartment and having a storage space therein;

a cold air duct provided at a rear of the storage compartment and comprising a cold air outlet configured to discharge cold air into the storage space; and a partition disposed in the storage box, the partition configured to divide the storage space into a fresh room and a vegetable room and to be movable in a left direction and a right direction in the storage space, the partition comprising an adjusting plate configured to be moved in the left direction and the right direction to adjust a size of the cold air outlet.

17. The refrigerator according to claim 16, wherein the cold air outlet is formed on one side of the cold air duct at a position corresponding to the fresh room such that cold air is discharged only to the fresh room in the storage space.

18. The refrigerator according to claim 17, wherein, when the partition is moved in a direction in which a size of the fresh room decreases, cold air is discharged from an entirety of the cold air outlet to the fresh room while the partition is moved to a first position, wherein the first position is a position before the adjusting plate closes the cold air outlet.

19. The refrigerator according to claim 18, wherein, when the partition is further moved from the first position in the direction in which the size of the fresh room decreases so that the partition is moved to a second position where a portion of the cold air outlet is closed by the adjusting plate, an amount of cold air discharged from the cold air outlet to the fresh room is decreased.

20. The refrigerator according to claim 16, wherein:

the cold air outlet has a length extending in the left direction and the right direction of the cold air duct such that cold air is discharged to both the fresh room and the vegetable room, and a portion of the cold air outlet closed by the adjusting plate is configured to be adjusted according to a position of the partition so that an amount of cold air discharged to the fresh room and the vegetable room is adjusted.

* * * * *